US005315279A

United States Patent [19]

Ito et al.

[11] Patent Number: 5,315,279

[45] Date of Patent: May 24, 1994

[54] COIL DEVICE

[75] Inventors: Shinichiro Ito; Yukiharu Kinoshita, both of Tokyo, Japan

[73] Assignee: TDK Corporation, Tokyo, Japan

[21] Appl. No.: 658,901

[22] Filed: Feb. 22, 1991

[30] Foreign Application Priority Data

Feb. 27, 1990 [JP] Japan ..... 2-48830
Oct. 2, 1990 [JP] Japan ..... 2-264251
Oct. 2, 1990 [JP] Japan ..... 2-264252

[51] Int. Cl.[5] ..... H01F 17/04; H01F 27/24

[52] U.S. Cl. ..... 336/178; 336/83; 336/212

[58] Field of Search ..... 336/165, 178, 83, 134, 336/212; 335/281, 296, 997

[56] References Cited

U.S. PATENT DOCUMENTS 3,434,085 3/1969 Gang ..... 335/297
3,566,323 2/1971 Graf et al. .
3,787,790 1/1974 Hull .
4,282,567 8/1981 Voigt ..... 336/178

FOREIGN PATENT DOCUMENTS 518715 10/1981 Australia .
922423 1/1955 Fed. Rep. of Germany .
3123006 1/1983 Fed. Rep. of Germany .
1490564 6/1967 France .
53-53850 12/1978 Japan .
55-77115 6/1980 Japan .
57-130402 8/1982 Japan .
60-7448 3/1985 Japan .

OTHER PUBLICATIONS

Patent Abstracts of Japan, vol. 4, No. 130 (E-25) (612) Sep. 12, 1980, & JP-A-55 83210 (Nippon Denshi K.K.).

*Primary Examiner*—Thomas J. Kozma
*Attorney, Agent, or Firm*—Armstrong, Westerman, Hattori, McLeland & Naughton

[57] ABSTRACT

The present invention provides a coil device including magnetic cores having gap regions and a coil wound to contain the gap regions. The present invention provides an improvement in which a shape of at least one of the opposing magnetic cores forming the gap regions is formed into a curve of logarithmic function from its base end to its extreme end, its most extreme end is provided with a gap adjusting flat surface and then a plurality of gaps are formed in the gap regions.

With such an arrangement as above, the present invention provides the coil device capable of reducing a leakage magnetic flux produced around the gaps, preventing an abnormal generation of heat of the coils and further preventing a bad influence of noise against a peripheral apparatus.

4 Claims, 10 Drawing Sheets

COIL DEVICE

BACKGROUND OF THE INVENTION

1. Field of the Invention

The present invention relates to improvements in a coil device for use in a flyback transformer, a switching power transformer, a choke coil or the like and more particularly it relates to improvements in a coil device employing a magnetic core with a gap.

2. Description of the Prior Art

In any of the conventional transformers, choke coils and so forth known heretofore, it is customary to form a gap in a closed magnetic path so that the magnetic core thereof is not saturated when a desired current is caused to flow. For example, when a ferrite magnetic core usually having a magnetic permeability $\mu$ of 5000 or so is used in a transformer, a gap is formed there to reduce the effective permeability $\mu$ within a range of 50 to 300.

This signifies that a gap having a great magnetic reluctance needs to be existence in a ferrite magnetic core of which magnetic reluctance is originally small, wherein a great leakage flux is generated in the periphery of the gap.

It is generally known that such leakage flux exerts at least two harmful influences as follows.

(1) Noise is induced in peripheral apparatus (components) which are prone to be effected by magnetic induction.

(2) In case the coil is so wound as to surround the gap, there occurs abnormal generation of heat in the coil around the gap due to the leakage flux.

For the purpose of solving the above problems, a variety of improvements have been developed.

In an attempt to settle the problem (1) above, there is contrived a coil device 1' of forming a gap merely in the coil alone. In FIG. 17 is illustrated a structure of this conventional type of coil device 1'.

This coil device 1' is constructed such that a sectionally U-shaped first magnetic core 2' is combined with a similarly sectionally U-shaped second magnetic core 3' and then a coil 6' is wound around portions of the magnetic cores 2' and 3'.

The first magnetic 2' and the second magnetic core 3' have legs 2a' and 3a', respectively. The first magnetic core 2' and the second magnetic core 3' are arranged such hat the first leg 2a' and the first leg 3a' are oppositely faced to each other via a gap 5'. The coil 6' is wound so as to cover the gap 5' within it. The opposing legs 2a' and 3a' are formed into such a shape as one in which their lateral sectional areas become equal to each other over their entire lengths. As a combination of the magnetic cores, there may be another sectionally E-shaped magnetic core.

A B-H curve shown in FIG. 18 shows a data found in the prior art coil device 1'. As shown in this figure, a maximum flux density Bm of the conventional type of coil device 1' is 5510 Gs.

Table 1 below indicates a result of measurement of temperature in a coil center X, a coil end Y, a core Z and a periphery W of the conventional type of the coil device 1' of E-shaped section measured by a testing device Tb shown in FIG. 16 (Test condition: Frequency 100 KHz, Sine wave of 0.8 A and Ambinent temperature of 40°).

TABLE 1

(°C.)

| Structure | X Coil center | Y Coil end | Z Core | W Periphery |
|---|---|---|---|---|
| Prior Art | 101.5 | 81.0 | 67.5 | 51.0 |

As indicated in Table 1, a mere arrangement of the gap 5' only in the coil 6' causes a high temperature of more than 100° C. at the coil center X and further the problem (2) above is expanded more.

As regards the problem (2) above, as already disclosed in Japanese Patent Laid-Open No. 55-77115 and Japanese Utility Model Laid-Open No. 57-130402, this problem is resolved by a method wherein the gap placed within the coil is divided magnetically into a series of plural segments so as to disperse a concentration of leakage magnetic flux. In addition, there are Japanese Utility Model Publication No. 53-53850 and Japanese Utility Model Publication No. 60-7448 in order to resolve the problems (1) and (2) above. These utility models use material as a gap filler of a material having a large specific permeability than that of air (more than 1), reduce magnetic reluctance at the gap and further decrease the leakage magnetic flux.

As described above, in case that the material quality having a greater relative permeability than that of air (more than 1) is arranged within the coil as the gap member, there is a possibility that the problems (1) and (2) above can be improved to a certain degree.

However, even in this case, there remains a problem that a leakage magnetic flux may be concentrated at an interface part between the gap and the magnetic core. In addition, there is a new problem that it is hard to get such material as one in which it has an appropriate permeability as the gap filling material, a high saturated magnetic flux density and a low magnetic core loss characteristic corresponding to the magnetic core. Due to this fact, this system may generate the following new problem. Namely, the coil wound over the interface part between the gap and the magnetic core may generate heat abnormally. In addition, the gap may also generate heat abnormally due to the loss of magnetic core at the gap filling material. Further, the B-H curve of the magnetic core having the gap filling material therein becomes non-linear form and if this is used in a transformer, it may produce a deformed wave form. This is the present state that a more effective improvement may not be attained.

It is therefore an object of the present invention to provide a coil device capable of resolving the aforesaid problems, reducing influence of noise against the peripheral apparatus (component)r reducing a leakage magnetic flux generated around the gap and preventing an abnormal occurrence of heat in the coil. It is another object of the present invention to provide a coil device whose cost is less expensive and its reliability in operation is improved.

SUMMARY OF THE INVENTION

In order to accomplish the aforesaid objects, the present invention provides a coil device including magnetic cores having gap regions and coils wound to contain said gap regions characterized in that a shape of at least one of the opposing magnetic cores forming said gap regions is formed into a curve of a logarithmic function ranging from its base end to its extreme end, its most extreme end is provided with a gap adjusting flat surface and a plurality of gaps are formed in said gap regions.

The aforesaid magnetic cores may be made of C-shaped cores or a combination of U-shaped cores or E-shaped cores.

With such an arrangement above, there occurs no concentration of leakage magnetic flux between the gaps and the end surface of the magnetic core and further there is no gap filler material, resulting in that the magnetic core loss is not produced and the aforesaid objects can be attained.

DESCRIPTION OF THE PREFERRED EMBODIMENTS

Figure 1A:
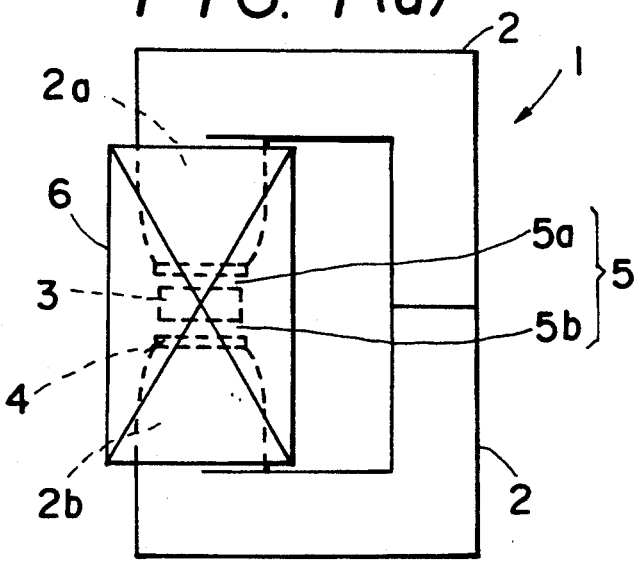
FIGS. 1(*a*) and (*b*) are a schematic view and a top plan view for showing a first preferred embodiment of the present invention.

Referring now to the drawings, some preferred embodiments of the present invention will be described.

Figure 1B:
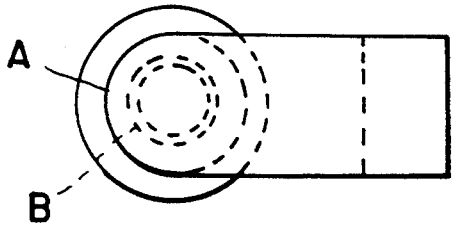

The coil device 1 of a first preferred embodiment of the present invention shown in FIGS. 1(*a*) and (*b*) is substantially composed of two sectionally U-shaped magnetic cores 2 coupled to each other to form a gap region 5, and coil 6 wound to include the gap region 5.

The magnetic core 2 has opposing first leg 2*a* and second leg 2*b*. A gap region 5 is formed between these both legs 2*a* and 2*b*. A core member 3 is arranged at the intermediate part of the gap region 5 so as to form a first gap 5*a* and a second gap 5*b* by this core member 3. The coil 6 is wound so as to cover the gaps 5*a* and 5*b*. The magnetic-core 2 and the core member 3 are made of ferrite, for example.

Figure 2:
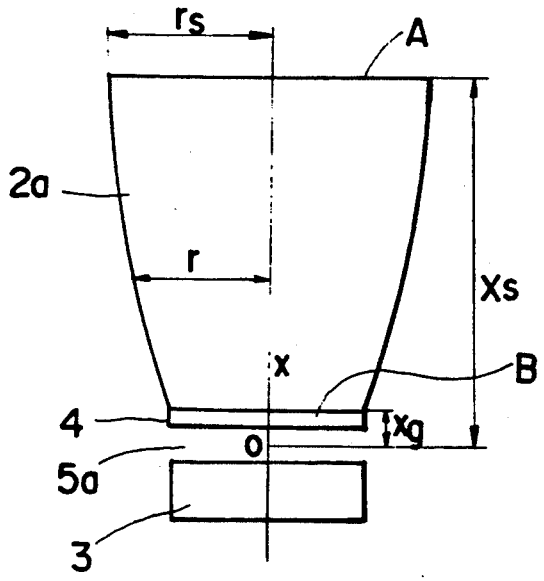
FIG. 2 shows a shape of leg forming a gap region shown in FIG. 1(*a*).

As shown in FIG. 2, a shape of each of the opposing first leg 2*a* and the first leg 2*b* around which the coil 6 is wound is formed such that a lateral sectional area of an extreme end B is smaller than a lateral sectional area of a base end A and further it has a curved shape given by a logarithmic function. Such a shape of the extreme end can be expressed by the logarithmic function of the following equation.

$$r_s - r = x_g l_n (X_s/x)$$

where, x: distance from a center O of the gap 5*a* toward central axes of the legs 2*a* r: distance from the central axes of the legs 2*a* toward a radial direction $r_s$: radius of a base end A of legs 2*a*

$X_s$: distance from the base end A to the center O of the gap 5

$x_g$: distance from the extreme end B to the center O of the gap 5

The extreme end B of each of the opposing first legs 2*a* and 2*b* around which the coil 6 is wound is provided with a core member 4 having a flat surface as shown in FIG. 2. The core member 4 is used for shaving partially the flat surface in parallel when the gap 5 between the legs 2*a* and 2*b* is to be adjusted. Even if this flat surface is partially shaved, an area at the extreme end surface is not varied, resulting in that a characteristic of the device is not varied and its adjustment can be carried out. The core member 4 is made of ferrite, for example.

Figure 3A:
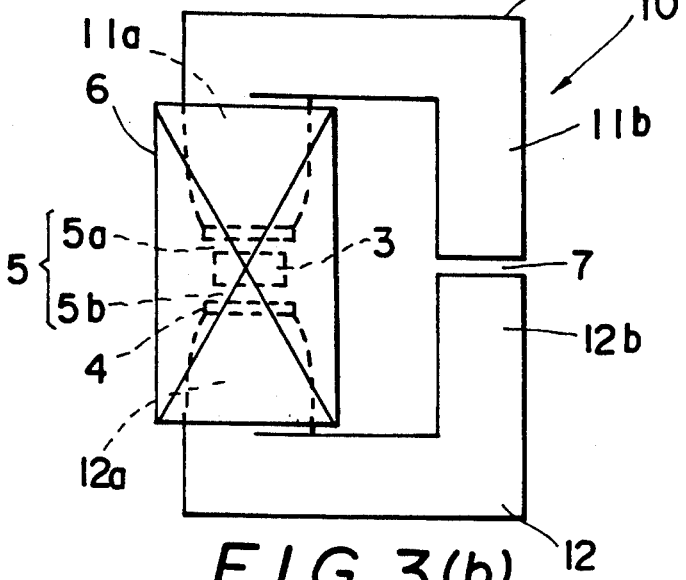
FIGS. 3(*a*) and (*b*) are a schematic view and a top plan view for showing a coil device of a second preferred embodiment of the present invention.
Figure 3B:
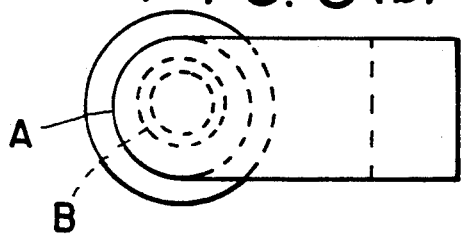

The coil device 10 of the second preferred embodiment shown in FIGS. 3(*a*) and (*b*) is constructed such that the sectionally U-shaped first magnetic core 11 is coupled to the similarly sectionally U-shaped second magnetic core 12 so as to form gaps 7 at the position opposing to the position in the gap region 5 of the sectionally U-shaped magnetic core 2 of the coil device 1 shown in FIG. 1 and then the coil, 6 is wound to include the gap region 5.

The first magnetic core 11 has a first leg 11*a* and a second leg 11*b*, and the second magnetic core 12 has a first leg 12*a* and a second leg 12*b*. The first magnetic core 11 and the second magnetic core 12 are arranged such that each of the first leg 11*a* and the first leg 12*a*, and the second leg 11*b* and the second leg 12*b* is oppositely faced to each other via gap regions 5 and the gap 7. The first legs 11*a* and 12*a* around which the coil 6 is wound are similarly constructed as that of the legs 2*a* and 2*b* of the coil device 1 shown in FIG. 1, respectively.

Figure 4A:
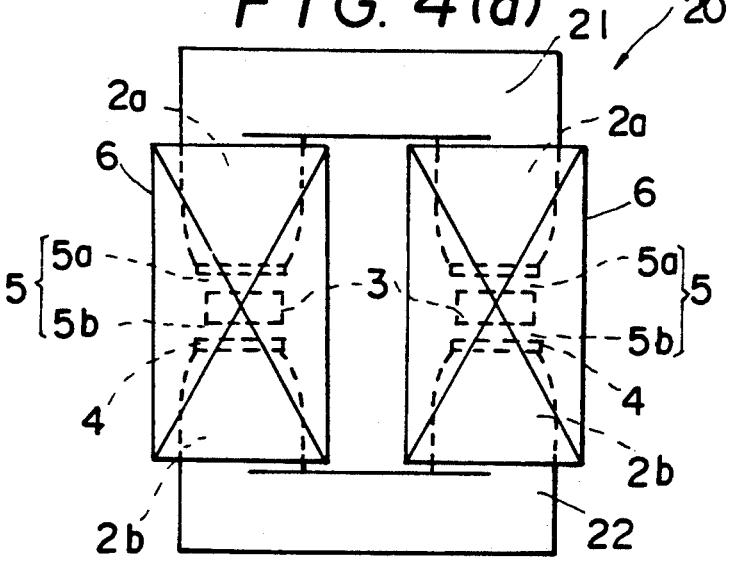
FIGS. 4(*a*) and (*b*) illustrate a schematic view and a top plan view of a coil device of a third preferred embodiment of the present invention.
Figure 4B:
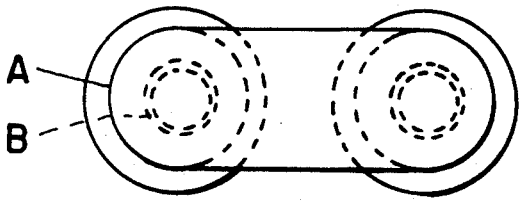

The coil device 20 of the third preferred embodiment of the present invention shown in FIGS. 4(*a*) and (*b*) is constructed such that the sectionally U-shaped first magnetic core 21 and the similarly sectionally U-shaped second magnetic core 22 are coupled to each other and then the coils 6 are wound around a part of the magnetic cores 21 and 22.

The first magnetic core 21 has the first two legs 2*a* of the first preferred embodiment device 1 and the second magnetic core 22 has the first two legs 2*b* of the first preferred embodiment device 1. Each of the magnetic cores 21 and 22 is arranged so as to oppositely face against to each other via the gap region 5 similarly to that of the first preferred embodiment device 1. The coils 6 are wound to cover each of the gap regions 5 therein.

Figure 5A:
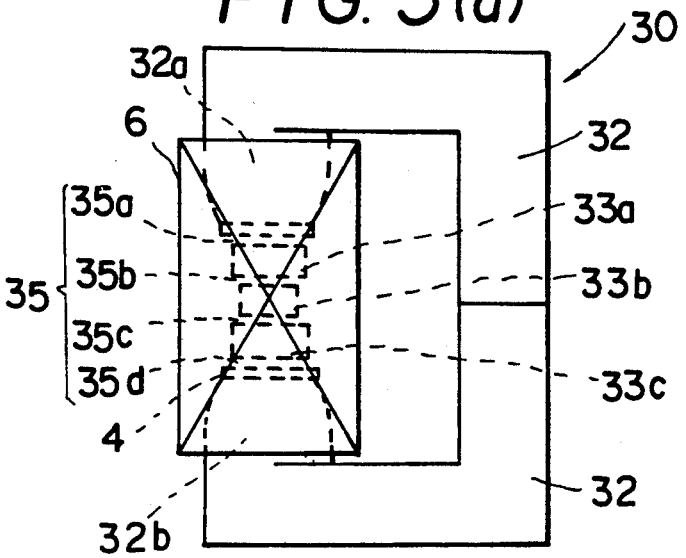
FIGS. 5(*a*) and (*b*) illustrate a schematic view and a top plan view for showing a coil device of a fourth preferred embodiment of the present invention.
Figure 5B:
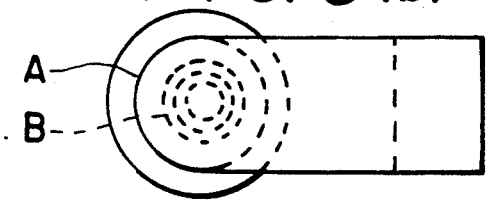

The coil device 30 of the fourth preferred embodiment shown in FIGS. 5(*a*) and (*b*) is made such that the gap regions 5 in the coil device 1 shown in FIG. 1 are applied as gap regions 35 having the first core member 33*a*, the second core member 33*b* and the third core member 33*c* arranged therein.

The sectionally U-shaped magnetic core 32 has a first leg 32*a* and a second leg 32*b* oppositely faced to each other in the same manner as that of the coil device 1 shown in FIG. 1. Each of the legs 32*a* and 32*b* is constructed in the same manner as that of the legs 2*a* and 2*b* of the coil device 1 shown in FIG. 1.

A first gap 35*a*, a second gap 35*b*, a third gap 35*c* and a fourth gap 35*d* are formed by the first to third core members 33*a*, 33*b* and 33*c*. The coil 6 is wound to cover these gaps 35*a* to 35*d*.

Figure 6A:
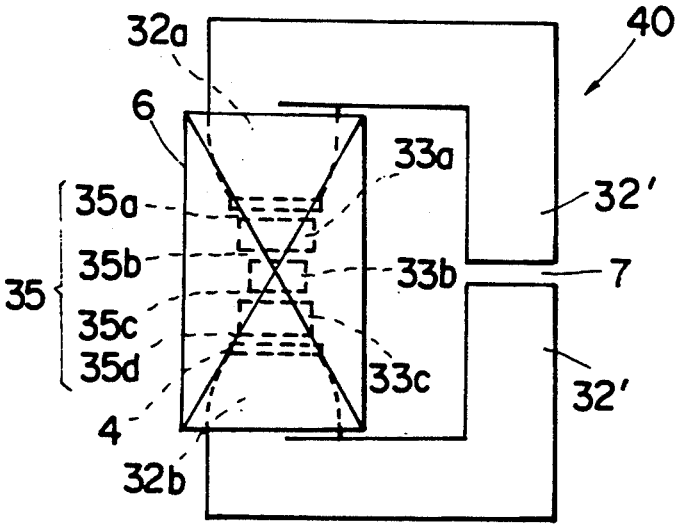
FIGS. 6(*a*) and (*b*) illustrate a schematic view and a top plan view for showing a coil device of a fourth preferred embodiment of the present invention.
Figure 6B:
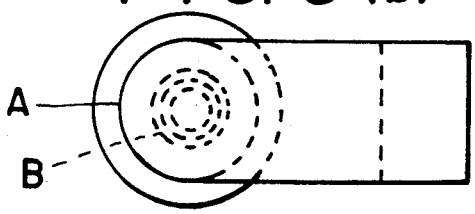

The coil device 40 of the fifth preferred embodiment of the present invention shown in FIGS. 6(*a*) and (*b*) is constructed such that the sectionally U-shaped magnetic core 32 of the coil device 30 shown in FIG. 5 is applied as the magnetic core 32' having gaps 7 in the same manner as that of the coil device 10 shown in FIG. 3.

Figure 7:
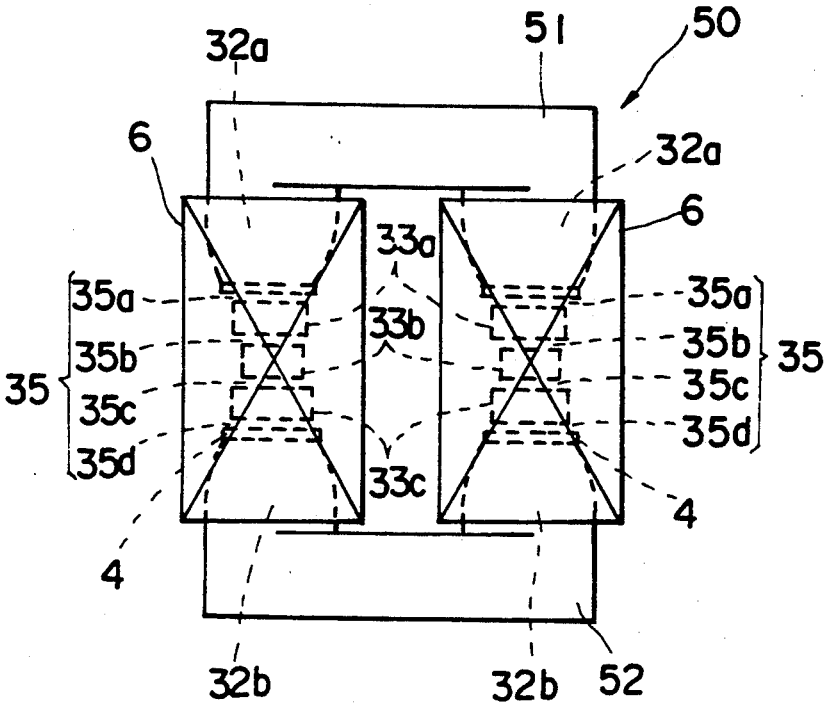
FIGS. 7(*a*) and (*b*) illustrate a schematic view and a top plan view for showing a coil device of a sixth preferred embodiment of the present invention.
Figure 7:
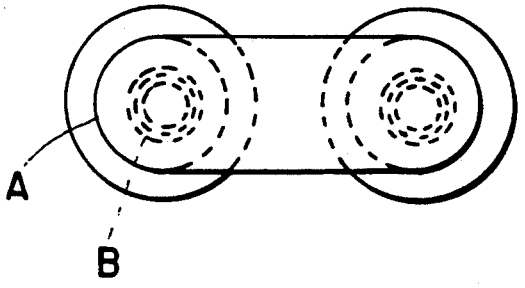

The coil device 50 of the sixth preferred embodiment of the present invention shown in FIGS. 7(*a*) and (*b*) is made such that the gap regions 5 of the coil device 20 shown in FIG. 4 are made in the same manner as that of the gap regions 35 of the coil device 30 shown in FIG. 5. A first magnetic core 51 and a second magnetic core 52 have a sectionally U-shaped magnetic core in the same manner as that of the coil device 20 shown in FIG. 4, respectively.

Figure 8:
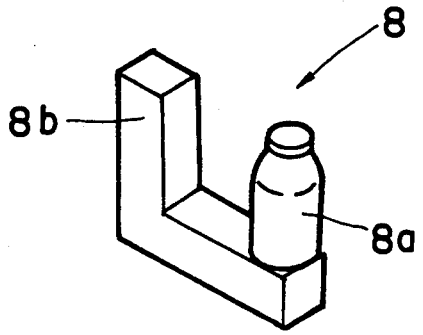
FIGS. 8(*a*), B(*b*) and 9 are perspective views for showing legs of the coil device shown in FIGS. 1 and 3 to 7, respectively.
Figure 8:
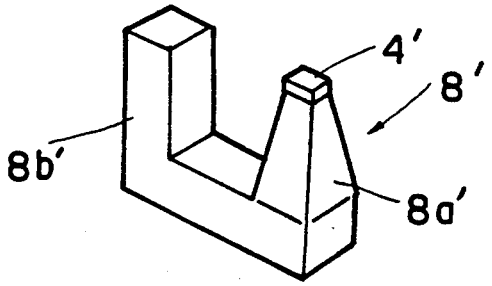

The sectionally U-shaped magnetic cores of the coil devices 10, 20, 40 and 50 shown in FIGS. 3, 4, 6 and 7 are of that shown in FIGS. 8(*a*), 8(*b*) and 9.

Figure 9:
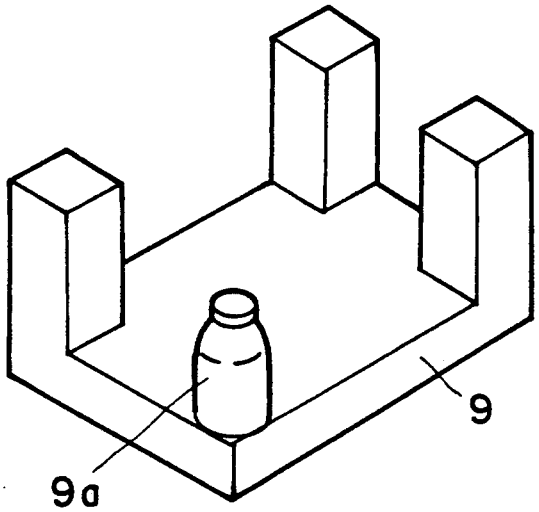

The magnetic core 8 shown in FIG. 8(*a*) is constructed such that a leg 8*b* of the magnetic core having no coil 6 wound therearound is formed into a square shape and the other leg 8*a* is formed into a column. A magnetic core 8' shown in FIG. 8(*b*) is constructed such that both legs 8*a'* and 8*b'* are made into square shapes and a gap adjusting core member 4' at the leg 8*a'* around which the coil 6 is wound is formed into a square shape. The magnetic core 9 shown in FIG. 9 is made such that the square magnetic cores of U-shape are coupled in parallel to each other and one leg 9*a* is formed into a column. Any of these legs have U-shaped sections. Although the practical arrangement is made such that the magnetic cores having such shapes as above are coupled in pairs, respectively, and the coils 6 are wound around the column-like legs 8*a* and 9*a* or the square leg 8*a'*, each of the figures showed only one side core. The magnetic cores are made of ferrite, for example.

Figure 10:
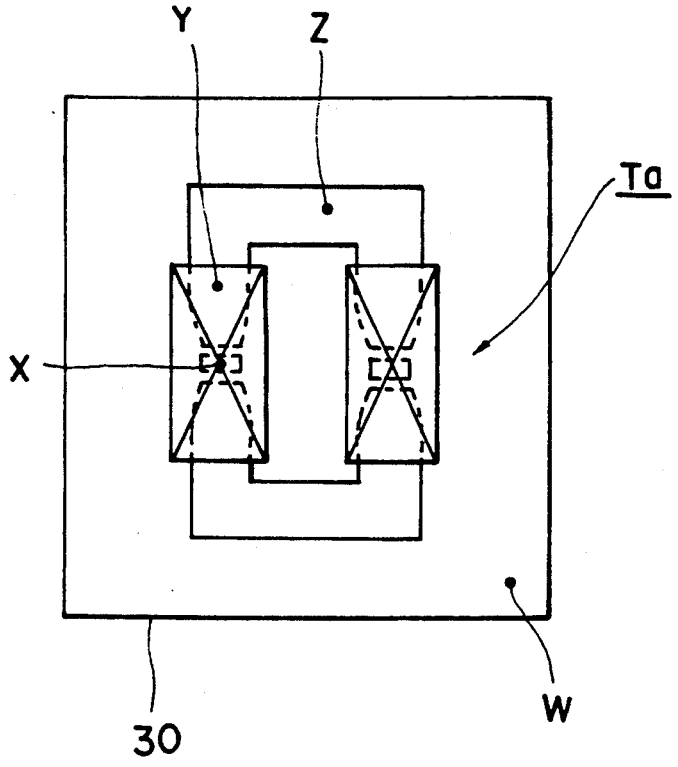
FIG. 10 illustrates a temperature measuring method for each of the points of the coil device of the present invention shown in FIGS. 1, 3 to 7.

Actions and effects of the aforesaid first to fourth preferred embodiments constructed as described above will be described in reference to FIG. 10 and table 2.

Table 2 indicates a comparison between the result of temperature measurement for each of the parts in the coil device got through each of the preferred embodiments and that of the prior art coil device 1'. The temperature measurement of each of the portions was carried out by using the testing device Ta shown in FIG. 10. (Test condition: Frequency of 100 KHz, 0.8 A Sine wave, Ambient temperature of 40° C.)

TABLE 2

| Structure | X Coil center | Y Coil end | Z Core | W Periphery |
|---|---|---|---|---|
| | | | | (°C.) |
| 1st Preferred Embodiment | 82.0 | 70.5 | 58.5 | 45.5 |
| 2nd Preferred Embodiment | 56.8 | 52.8 | 50.5 | 40.7 |
| 3rd Preferred Embodiment | 59.8 | 55.8 | 50.1 | 42.0 |
| 4th Preferred Embodiment | 75.1 | 67.6 | 55.2 | 43.6 |
| 5th Preferred Embodiment | 52.0 | 50.6 | 47.6 | 40.5 |
| 6th Preferred Embodiment | 54.8 | 53.5 | 47.3 | 41.6 |

As apparent from Table 2 above, according to each of the preferred embodiments of the present invention, it is acknowledged that temperatures at the coil center X, coil end Y, core Z and periphery W are lowered than that of the prior art. Accordingly, it is possible to prevent an abnormal generation of heat of the coil. The temperature is decreased in the above-mentioned embodiments compared to the conventional examples, because the fact that the core member 3 of the same material as the magnetic core is inserted. In addition, the assembling operation may easily be carried out, resulting in that a cost reduction of the device can be attained.

Figure 11:
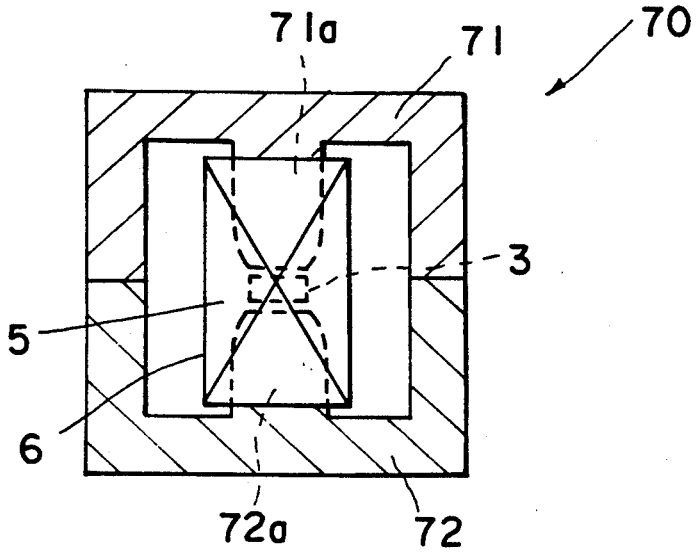
FIG. 11 is a schematic view for showing the coil device of a seventh preferred embodiment of the present invention.

The coil device 70 of the seventh preferred embodiment of the present invention shown in FIG. 11 is constructed such that the extreme ends of the two sectionally E-shaped magnetic cores 71 and 72 are abutted to each other. The coil device 70 is provided with central legs 71*a* and 72*a* having the same structure as that of the legs 2*a* and 2*b* of the coil device 1 shown in FIG. 1 and the gap regions 5 similar to that of the coil device 1 shown in FIG. 1 are formed between the legs 71*a* and 72*a* and then the coil 6 is wound around the gaps.

Figure 12:
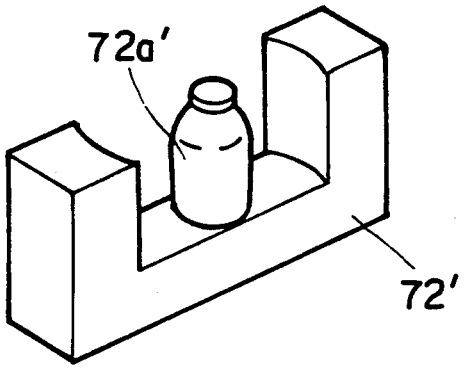
FIGS. 12(*a*), 12(*b*), 13 and 14 are perspective views for showing an example of the leg in the coil device shown in FIG. 11.
Figure 12:
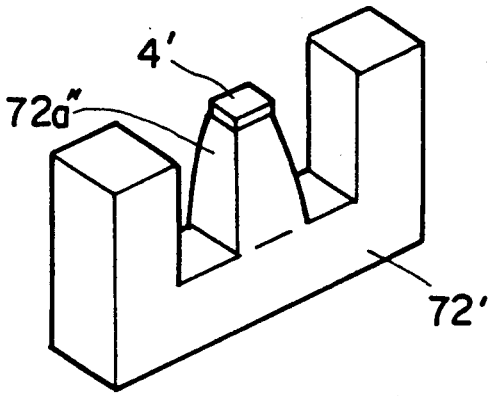
Figure 13:
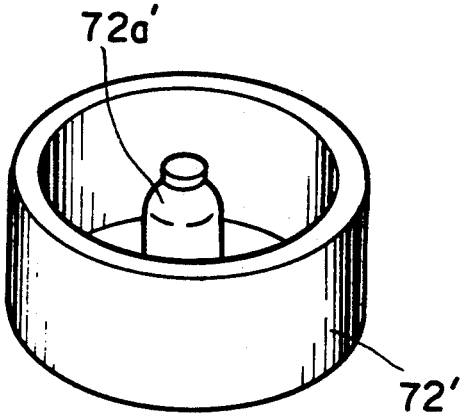
Figure 14:
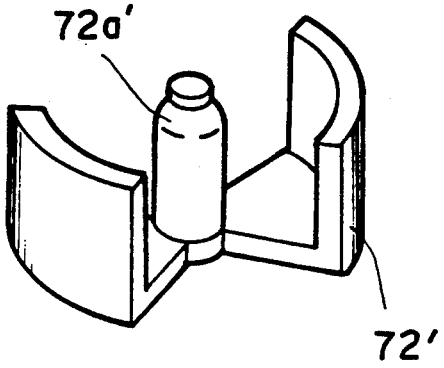

The aforesaid magnetic cores of E-shaped section are used as shown in FIGS. 12(*a*), 12(*b*), 13 and 14. That is, the device shown in FIG. 12(*a*) is made such that the magnetic core 72' is formed into an E-shape and a central leg 72*a'* is formed into a column. The device shown in FIG. 12(*b*) is made such that three legs of the magnetic core 72' shown in FIG. 12(*a*) are formed into square shapes and the gap adjusting core member 4' at the central leg 72*a''* around which the coil 6 is wound is formed into a square shape. The device shown in FIG. 13 is a so-called pot-type core 72' in which a column-like leg 72*a'* is formed at the central part of the cylinder having a bottom part. The device shown in FIG. 14 is made such that a part of the cylinder of the pot-type core shown in the aforesaid FIG. 13 is cut. Any of them has an sectionally E-shaped magnetic core. Although the practical device is made such that the devices of this shape are coupled in pairs and the coil 6 wound around the central legs 72*a'* and 72*a''*, respectively, each of the figures above shows only the device having one core. These magnetic core are made of ferrite, for example.

Action and effects of the seventh preferred embodiment device 70 constructed as above will be described in reference to FIGS. 15, 16 and Table 3.

Figure 16:
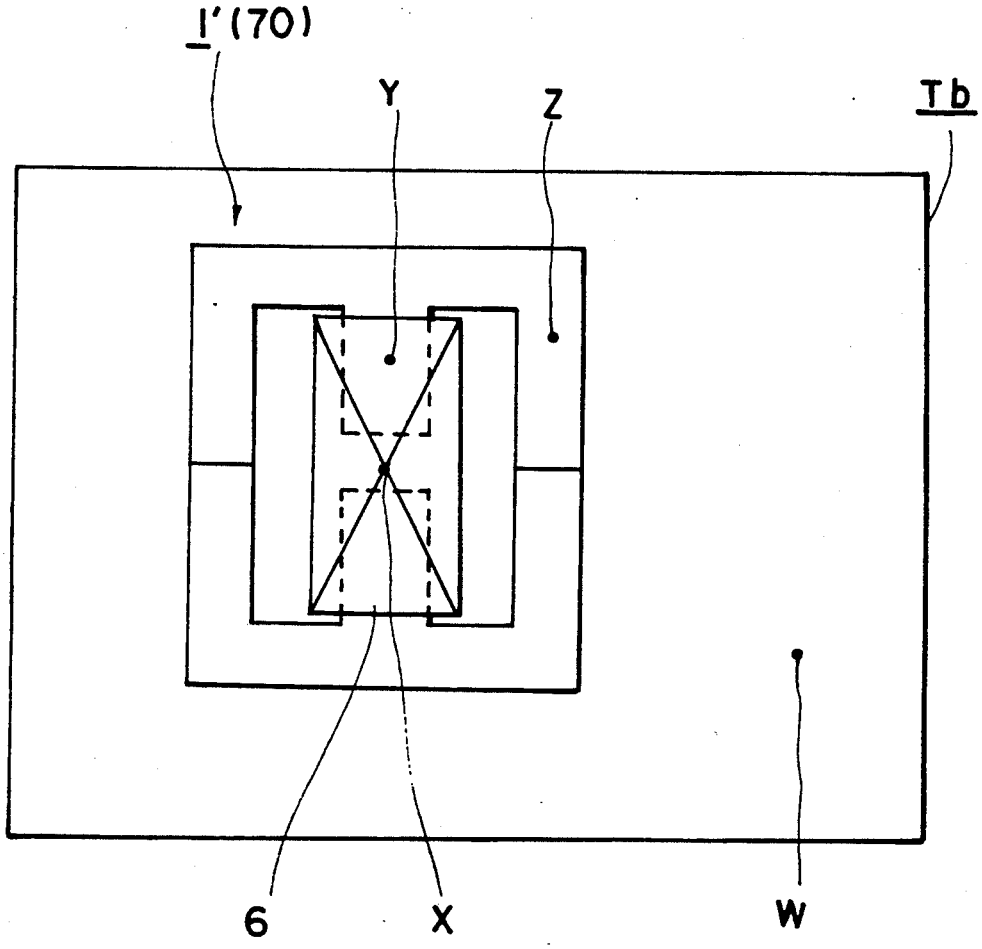
FIG. 16 illustrates a temperature measuring method for each of the points at the coil device using a core of E-shaped section.
Figure 17:
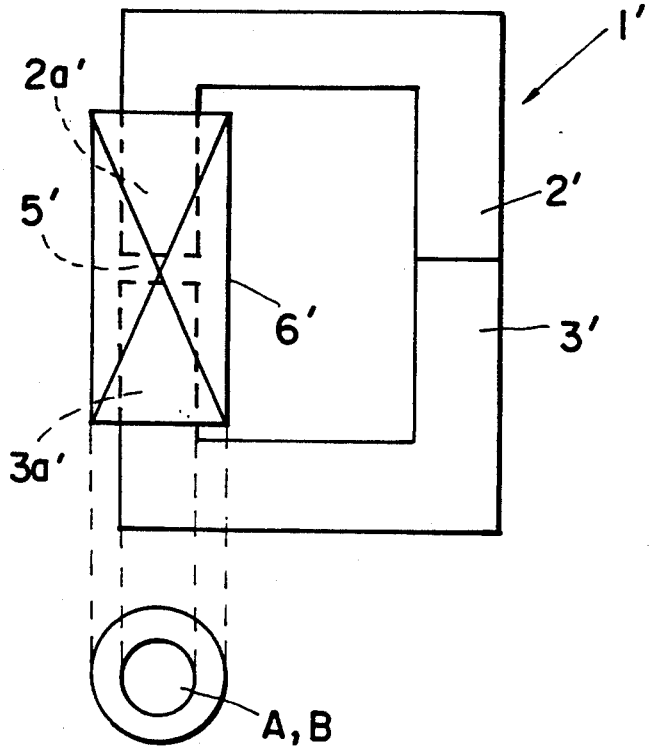
FIG. 17 is a schematic view and a top plan view for showing an example of the prior art.
Figure 18:
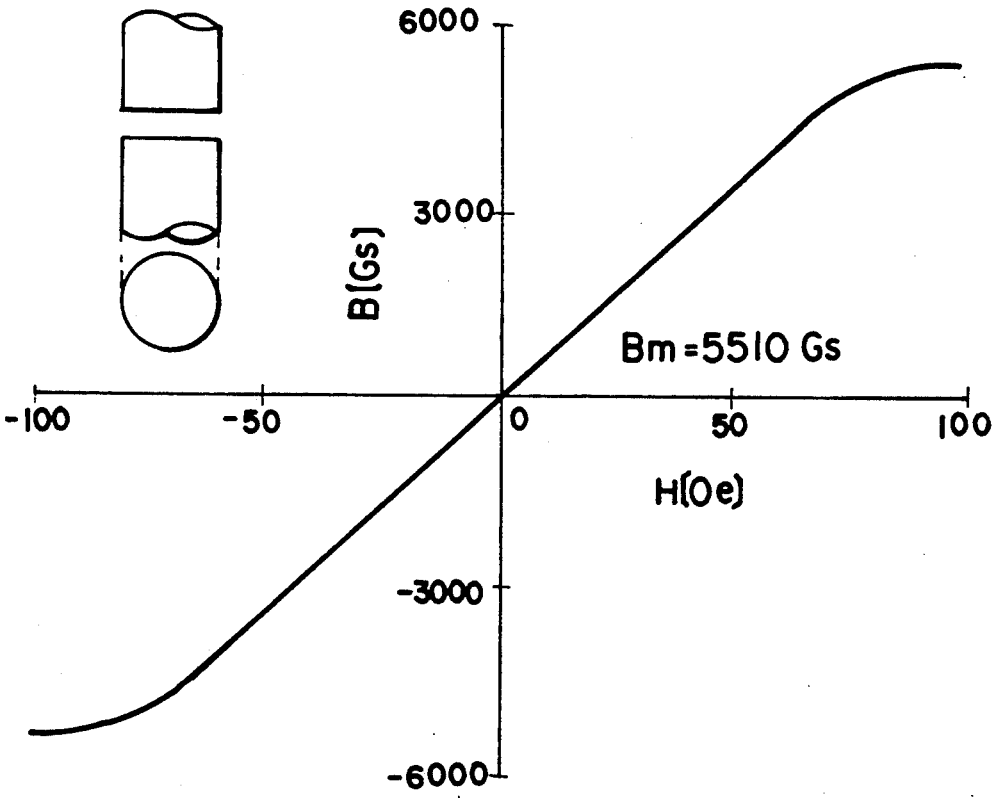
FIG. 18 is a B-H curve diagram for the coil device of the prior art.

Table 3 indicates a result of temperature measurement of the coil center X, coil end Y, core Z and periphery W of the aforesaid coil device 70 by applying the testing device Tb shown in FIG. 16 (Test condition: frequency 100 KHz, 0.8 A Sine wave, Ambient temperature 40° C.). In FIG. 16, the core member 3 shown in FIG. 11 is eliminated for its illustration.

TABLE 3

(°C.)

| X Coil center | Y Coil end | Z Core | W Periphery |
|---|---|---|---|
| 82.0 | 70.5 | 58.5 | 45.5 |

As indicated in table 3, the coil device 70 of the present invention shown in FIG. 11 shows, as compared with the coil device 1' of the prior art, a lower temperature of coil center X by 19.5° C., a coil end Y by 10.5° C., a core Z by 9° C. and a periphery W by 5.5° C., respectively. In this way, in comparison with a conventional device the reason why the coil device 70 of the present invention shown in FIG. 11 shows a reduced temperature consists in the fact that the core member 3 having the same material quality as that of the magnetic core is inserted. Since the assembling operation may easily be carried out, it is possible to reduce a cost.

Figure 15:
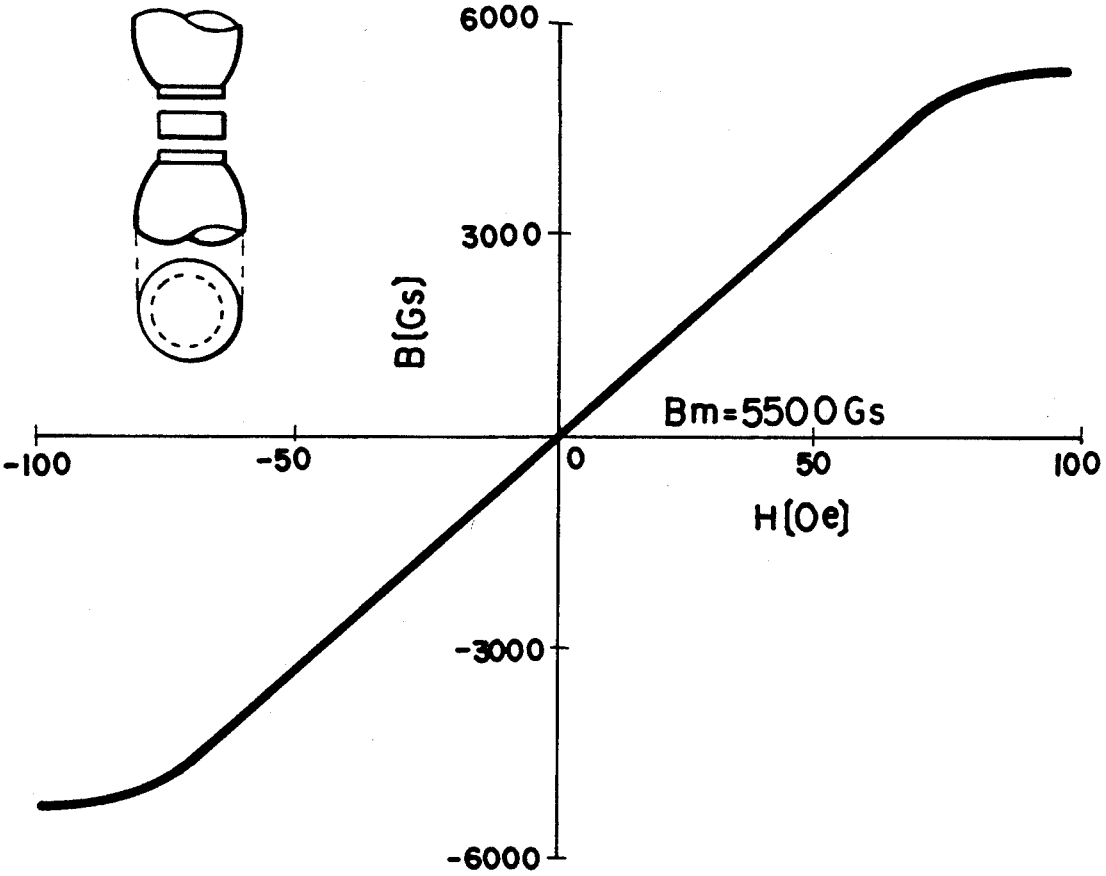
FIG. 15 is a B-H curve of the coil device shown in FIGS. 1, 3, 4 and 11.

In addition, it is apparent that the maximum magnetic flux density Bm of the coil devices 1, 10, 20 and 70 having two gaps within the gap regions shown in FIGS. 1, 3, 4 and 11 was 5510 Gs as indicated in the B-H curve indicated in FIG. 15, it is a low value of 5500 Gs and its linear characteristic may not be varied. Since the region keeping a linear characteristic is almost invariant, the practical operation may not be deteriorated even if the density Bm is decreased to such a low degree.

We claim:

1. A coil device including magnetic cores of ferrite material having gap regions and a respective coil wound around each gap region, wherein a shape of at least one of the opposing magnetic cores defining a respective gap region has the same shape as seen from at least four side surfaces and is formed into a curve of a logarithmic function from a base end to an extreme end, said extreme end of said at least one magnetic core being providing with a gap adjusting flat surface and wherein a plurality of gaps are formed in at least one of said gap regions.

2. A coil device according to claim 1 in which said magnetic cores are of C-shaped cores.

3. A coil device according to claim 1 in which said magnetic cores are of coupled U-shaped cores.

4. A coil device according to claim 1 in which said magnetic cores are of coupled E-shaped cores.

* * * * *